US009657500B2

(12) United States Patent
Min et al.

(10) Patent No.: US 9,657,500 B2
(45) Date of Patent: May 23, 2017

(54) ELECTRONIC-MECHANICAL DUAL CONTROL LOCK

(71) Applicant: Hao Min, Jiangsu (CN)

(72) Inventors: Hao Min, Nanjing (CN); Jianping Sun, Nanjing (CN)

(73) Assignee: NANJING EASTHOUSE ELECTRICAL CO., LTD., Nanjing, Jiangsu (CN)

( * ) Notice: Subject to any disclaimer, the term of this patent is extended or adjusted under 35 U.S.C. 154(b) by 0 days.

(21) Appl. No.: 15/307,912

(22) PCT Filed: Nov. 12, 2014

(86) PCT No.: PCT/CN2014/090932

§ 371 (c)(1),
(2) Date: Oct. 31, 2016

(87) PCT Pub. No.: WO2015/165248

PCT Pub. Date: Nov. 5, 2015

(65) Prior Publication Data

US 2017/0051532 A1 Feb. 23, 2017

(30) Foreign Application Priority Data

Apr. 29, 2014 (CN) ..... 2014 1 0175979

(51) Int. Cl.
*E05B 47/00* (2006.01)
*E05B 65/00* (2006.01)
*E05C 3/00* (2006.01)

(52) U.S. Cl.
CPC ..... *E05B 47/0001* (2013.01); *E05B 65/0075* (2013.01); *E05C 3/00* (2013.01);
(Continued)

(58) Field of Classification Search
CPC ..... E05B 65/0075; E05B 47/0001; E05B 2047/0021; E05B 2047/0084; E05B 47/06;
(Continued)

(56) References Cited

U.S. PATENT DOCUMENTS 4,899,562 A * 2/1990 Gartner ..... G07C 9/0069 70/277
4,967,577 A * 11/1990 Gartner ..... E05B 37/08 70/279.1
(Continued)

FOREIGN PATENT DOCUMENTS

CN 102400608 A 4/2012
CN 103233621 A 8/2013
(Continued)

OTHER PUBLICATIONS

International Search Report for PCT/CN2014/090932, Filed on Nov. 12, 2014. The International Search Report Was Issued on April 9, 2015.

*Primary Examiner* — Suzanne Barrett

(57) ABSTRACT

An electronic-mechanical dual control lock includes an electronic control mechanism, a mechanical control mechanism, a half gear, a cam, a rotary plug, and a rotary tongue. The electronic control mechanism includes an electronic actuating part and an engaging groove gear. The electronic actuating part is meshed with the engaging groove gear. A bottom surface of the engaging groove gear is fit with a bottom surface of the cam. The mechanical control mechanism includes a mechanical actuating part and the half gear. The mechanical actuating part is meshed with the half gear. The cam is driven by the engaging groove gear and the half gear separately and independently. The rotary plug includes a rotary shaft and a plug body. The rotary shaft is arranged at one end of the plug body and is engaged in the cam. The
(Continued)

plug body is a cylinder provided at a side thereof with a groove.

16 Claims, 6 Drawing Sheets

(52) U.S. Cl.
CPC ..... *E05B 2047/0021* (2013.01); *E05B 2047/0084* (2013.01)

(58) Field of Classification Search
CPC ..... E05B 49/00; E05B 47/00; E05B 17/00; E05B 37/00; E05C 3/00; E05C 3/06
USPC ..... 70/303 A, 333 R, 416
See application file for complete search history.

(56) References Cited

U.S. PATENT DOCUMENTS 5,142,890 A * 9/1992 Uyeda ..... E05B 47/0002 70/229
5,257,519 A * 11/1993 Miller, III ..... E05B 37/00 70/150
5,473,922 A * 12/1995 Bair ..... E05B 47/0012 292/144
5,487,290 A * 1/1996 Miller ..... E05B 17/2084 292/142
5,592,838 A * 1/1997 Clark ..... E05B 37/00 292/251.5
5,881,589 A * 3/1999 Clark ..... E05B 47/0012 70/278.7
5,893,283 A * 4/1999 Evans ..... E05B 37/00 70/278.7
6,038,897 A * 3/2000 Dawson ..... E05B 9/00 70/289
6,094,952 A * 8/2000 Clark ..... E05B 17/2092 70/278.1
6,178,791 B1 * 1/2001 Hill ..... E05B 47/00 70/276
6,741,160 B1 * 5/2004 Dawson ..... G07C 9/00666 340/5.2
6,786,519 B2 * 9/2004 Gartner ..... E05B 17/2034 109/59 R
6,910,357 B2 * 6/2005 Hirvi ..... E05B 17/0062 70/416
7,461,872 B2 * 12/2008 Moon ..... E05B 17/2092 292/109
7,770,944 B2 * 8/2010 Yuan ..... E05B 47/0012 292/195
8,308,203 B1 11/2012 Spletzer et al.
8,826,709 B2 * 9/2014 Dehaven ..... E05B 17/0062 70/333 R
9,080,349 B2 * 7/2015 Burrus ..... E05B 37/00
9,458,647 B2 * 10/2016 Gartner ..... E05B 17/2092
2008/0073916 A1 * 3/2008 Min ..... E05B 47/0603 292/201
2008/0276672 A1 * 11/2008 Gartner ..... E05B 47/0002 70/277
2008/0314100 A1 * 12/2008 Min ..... E05B 47/0012 70/278.1
2010/0257906 A1 10/2010 Sorensen et al.

FOREIGN PATENT DOCUMENTS

CN 103334647 A 10/2013
CN 103993786 A 8/2014
CN 203879136 U 10/2014

* cited by examiner

ELECTRONIC-MECHANICAL DUAL CONTROL LOCK

FIELD

The present invention relates to the technical field of locksets, and more particularly to an electronic-mechanical dual control lock.

BACKGROUND

The existing locksets used in safety boxes are generally mechanical locks or electronic locks. The mechanical coded locks include ordinary mechanical coded locks and highly-secure mechanical coded locks. For the ordinary mechanical coded lock, a small quantity of codes are applicable and the security is poor. For the highly-secure mechanical coded lock, a large quantity of codes are applicable and the security is good, but the operations, for example, code entering and code changing, are complicated, resulting in poor usability. An electronic coded lock has a large number of electronic devices, leading to a complex structure and high fault rate; besides, the electronic devices should be protected against moisture, strong magnetoelectricity, and strong vibration, putting certain requirements on the operating environment. The mechanical locks may easily avoid these disadvantages by taking some measures. A faulty electronic lock may cause great inconvenience to a user and is inconvenient to fix, such that the user can do nothing but nail-biting. Many electronic locks have backup mechanical unlocking means (for an emergency), which undoubtedly decreases the security of the locksets.

An early-stage electronic lock is generally powered by the mains supply and is power consuming. An existing integrated circuit electronic lock consumes a little power, where a button cell can maintain the operation of a control part, but an electromagnet or a motor needs to be actuated with a larger battery or the mains supply. On the contrary, the problem does not need to be considered for the mechanical lock. In spite of the above problem, the electronic lock has advantages of a large quantity of codes and key-free operation.

An electronic lock has apparently higher security than a mechanical lockset in avoiding technical unlocking, because the mechanical lockset can be easily technically opened within a short period of time, while the electronic lock is hard to be technically opened within a short period of time. However, the electronic lock has many problems. For example, the codes may be easily forgotten or leaked due to improper safekeeping, the battery of the electronic lock runs out, or a fault occurs in the devices of the electronic lock. Whenever such problems occur, the electronic lock can only be opened through destructive unlocking in most cases.

Therefore, in recent years, a mechanical lock is usually adopted as a mechanical backup lock of an electronic lock, to solve the above problems in the electronic lock. However, an existing electronic-mechanical lock has a small quantity of codes and poor capability of preventing technical unlocking, is complex in structure and operation, and is unstable in switching between an electronic unlocking mode and a mechanical unlocking mode.

SUMMARY

In view of the disadvantages in the prior art, the present invention provides a lockset switchable between a mechanical structure and an electronic structure.

To achieve the above objective, the present invention adopts the following technical solution: An electronic-mechanical dual control lock is provided, which includes an electronic control mechanism, a mechanical control mechanism, a half gear, a cam, a rotary plug, and a rotary tongue, where the electronic control mechanism includes an electronic actuating part and an engaging groove gear, the electronic actuating part being meshed with the engaging groove gear, and a bottom surface of the engaging groove gear being fit with a bottom surface of the cam;

the mechanical control mechanism includes a mechanical actuating part and the half gear, the mechanical actuating part being meshed with the half gear, and the cam is driven by the engaging groove gear and the half gear separately and independently;

the rotary plug includes a rotary shaft and a plug body, the rotary shaft being arranged at one end of the plug body and is engaged in the cam, and the plug body being a cylinder provided at a side thereof with a groove; and in the case of locking, the physical part at the groove of the plug body of the rotary plug rotates into a moving passage of the rotary tongue; and in the case of unlocking, the physical part at the groove of the plug body of the rotary plug rotates out of the moving passage of the rotary tongue.

Preferably, the rotary shaft sequentially passes through the half gear, the cam, and the engaging groove gear.

Preferably, the electronic actuating part includes a gear motor and a motor actuated gear, the motor actuated gear being meshed with the engaging groove gear, and the gear motor being used to drive the motor actuated gear.

Preferably, the cross-section of the rotary plug is circular or rectangular; and the cross-section at the groove of the rotary plug is semicircular or rectangular.

Preferably, the cam includes a boss and fasteners, the fasteners being arranged on the bottom surface of the cam fit with the engaging groove gear, and the boss being arranged on a side edge of the cam.

Preferably, fasteners are arranged on the bottom surface of the engaging groove gear fit with the cam, and the engaging groove gear is fit with the cam through the fasteners.

Preferably, the half gear includes a shifting block, the shifting block being arranged on a bottom surface of the half gear opposite to the cam, and the shifting block being fit with the boss.

Preferably, the lock further includes a lock case. The electronic control mechanism, the mechanical control mechanism, the rotary plug, and the rotary tongue are all mounted in the lock case.

Preferably, the rotary tongue has a cross-section shape of a fan and has a rotary shaft located at a circle center of the fan.

The present invention further provides an electronic-mechanical dual control lock, which includes an electronic control mechanism, a mechanical control mechanism, a half gear, a cam, a rotary plug, and a rotary tongue, where the electronic control mechanism includes an electronic actuating part and an engaging groove gear, the electronic actuating part being meshed with the engaging groove gear; the mechanical control mechanism includes a mechanical actuating part and the half gear, the mechanical actuating part being meshed with the half gear; the cam is driven by the engaging groove gear and the half gear separately and independently;

the rotary plug includes a rotary shaft and a plug body, the rotary shaft being arranged at one end of the plug body, sequentially passing through the half gear, the cam, and the engaging groove gear, and being engaged in the cam, and the plug body being a cylinder provided at a side thereof with a groove; the groove of the plug body of the rotary plug is rotatable into or out of the moving trajectory of the rotary tongue.

The present invention has the following beneficial effects:

The present invention provides a lock switchable between a mechanical structure and an electronic structure, which is structurally simple, convenient, and practical.

Figure 1:
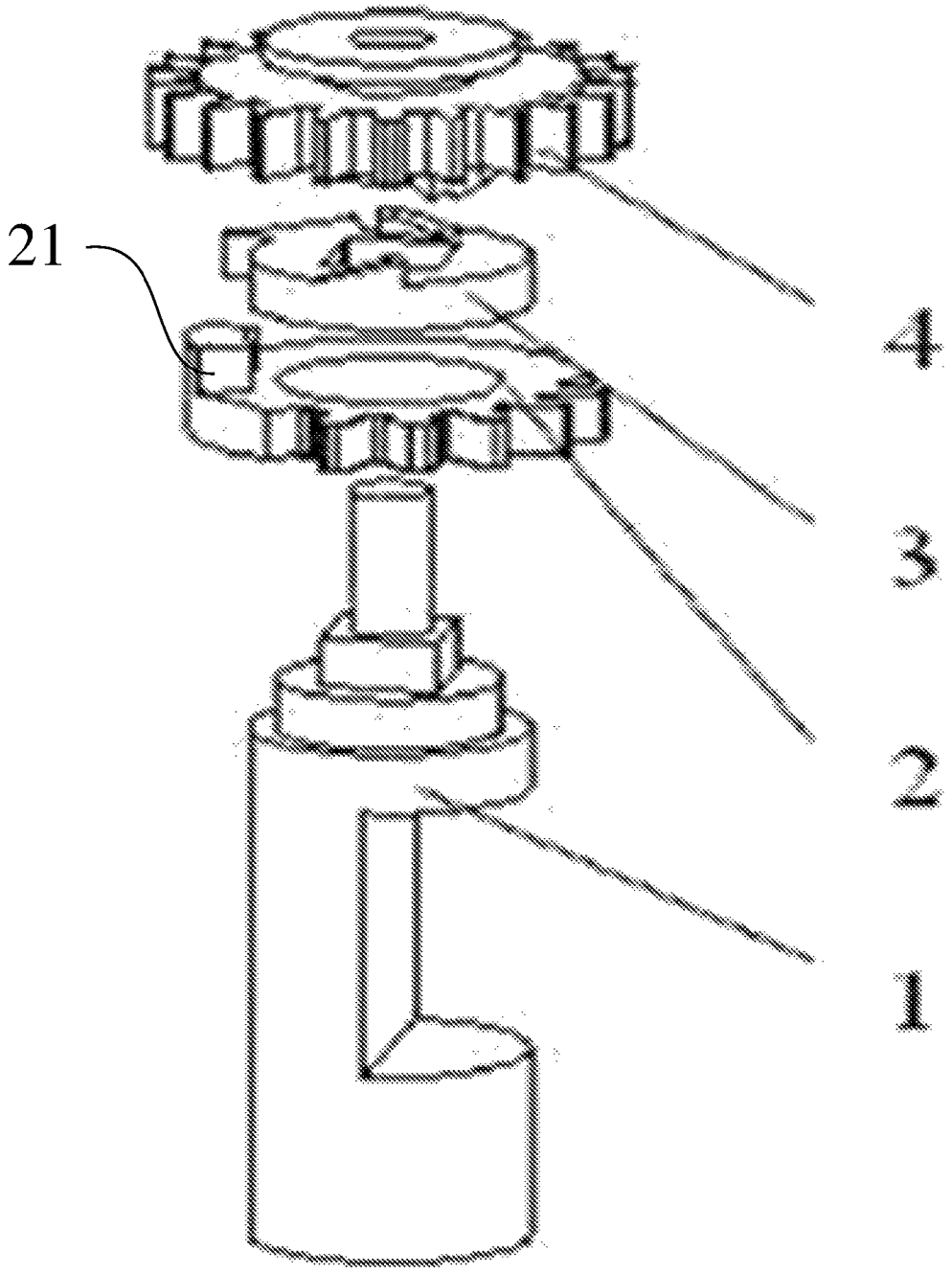
FIG. 1 is a schematic exploded structural view of an electronic control mechanism according to the present invention.

In the figures, 1. rotary plug, 2. half gear, 3. cam, 4. engaging groove gear, 5. boss, 6. fastener, 7. mechanical code shifting piece, 8. electronic actuating part, 9. transmission gear, 10. fan-shaped gear, 11. pulling claw, 12. rotary tongue.

DETAILED DESCRIPTION

In order to make the objectives and technical solutions of the embodiments of the present invention clearer, the technical solutions of the embodiments of the present invention are clearly and completely described below with reference to the accompanying drawings of the embodiments of the present invention. It is obvious that the described embodiments are merely a part rather than all of the embodiments of the present invention. Based on the described embodiments of the present invention, all other embodiments obtained by persons of ordinary skill in the art without making creative efforts shall fall within the protection scope of the present invention.

One of ordinary skill in the art can understand that unless otherwise defined, all terms (including technical and scientific terms) used herein have the same meaning as commonly understood by one of ordinary skill in the art to which this invention belongs. It should be further understood that, terms, such as those defined in commonly used dictionaries, should be understood as having a meaning consistent with their meaning in the context of the prior art, and will not be interpreted in an idealized or overly formal sense unless expressly so defined herein.

The term "and/or" in the present invention means that either or both elements may be present.

The terms "inner" and "outer" in the present invention refer to, relative to the device itself, the direction toward the interior of the device and the opposite direction respectively.

The terms "left" and "right" in the present invention refer to, when a reader is facing the drawing, the left side of the reader and the right side of the reader respectively.

The term "connection" in the present invention may refer to direct connection between components or indirection connection between components by means of other components.

The term "half gear" in the present invention refers to a gear on which only a part of the gear teeth exist, where the shape of the gear part may be a semicircle or a fan larger or smaller than a semicircle.

Figure 2:
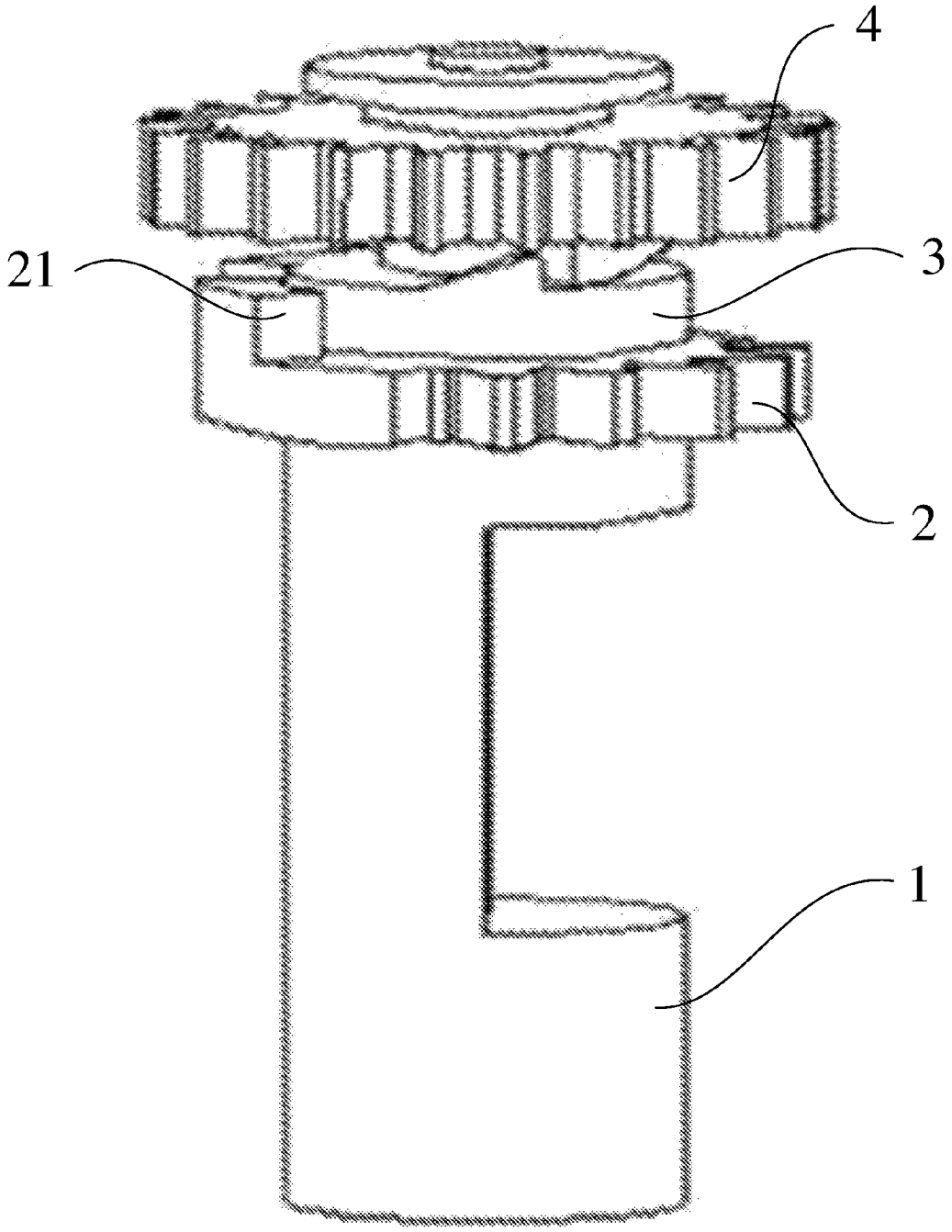
FIG. 2 is a schematic structural view of the electronic control mechanism according to the present invention.
Figure 3:
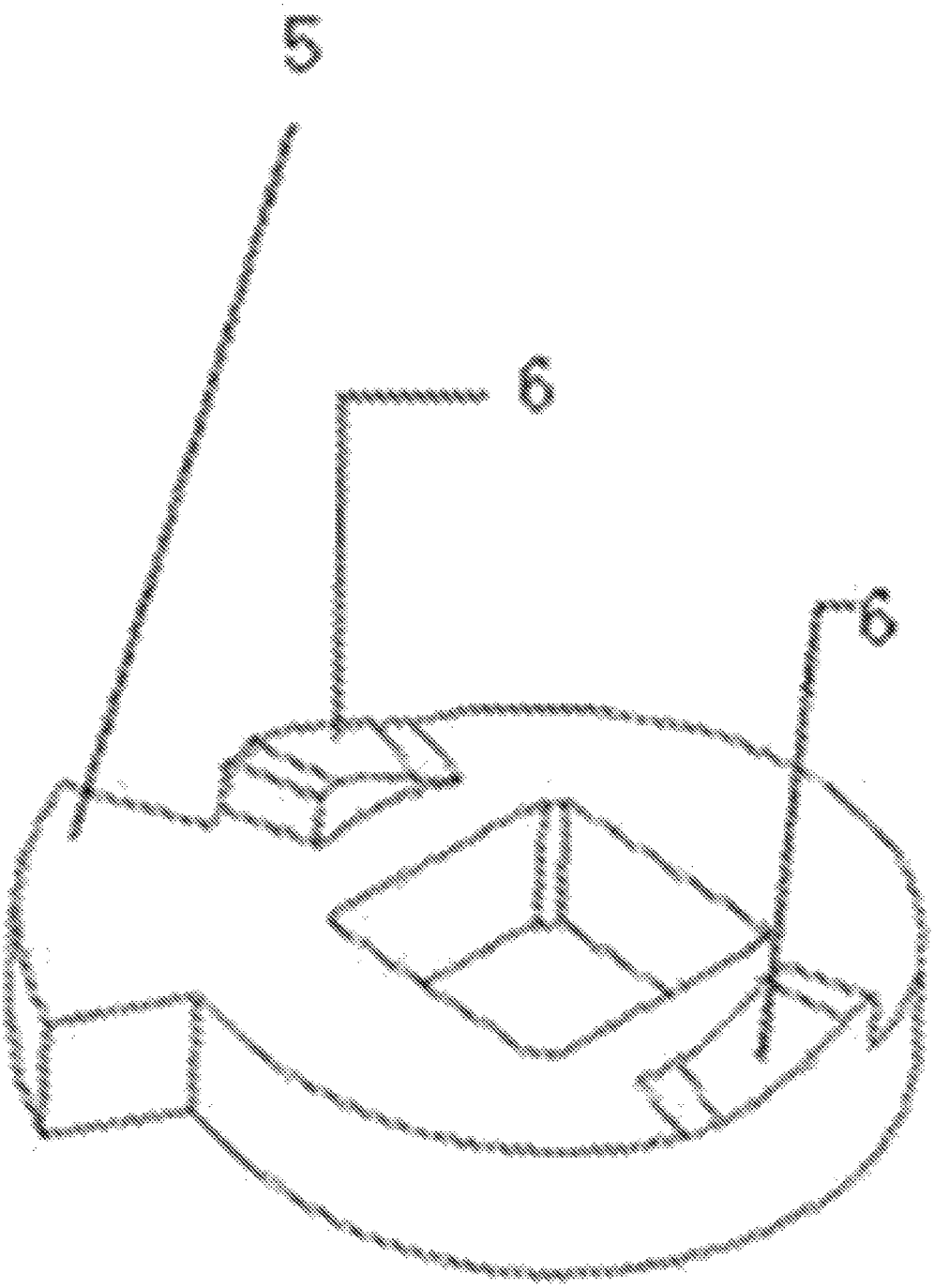
FIG. 3 is a schematic structural view of a boss according to the present invention.

An electronic-mechanical dual control lock of the present invention includes an electronic control mechanism, a mechanical control mechanism, a rotary plug, and a rotary tongue. As shown in FIG. 1 and FIG. 2, an electronic-mechanical dual control lock is provided, which includes an electronic control mechanism, a mechanical control mechanism, a half gear 2, a cam 3, a rotary plug 1, and a rotary tongue 12. The electronic control mechanism includes an electronic actuating part 8 and an engaging groove gear 4. The electronic actuating part 8 is meshed with the engaging groove gear 4. A bottom surface of the engaging groove gear 4 is fit with a bottom surface of the cam 3. The mechanical control mechanism includes a mechanical actuating part and the half gear 2. The mechanical actuating part is meshed with the half gear 2. The cam 3 is driven by the engaging groove gear 4 and the half gear 2 separately and independently. The rotary plug 1 includes a rotary shaft and a plug body. The rotary shaft is arranged at one end of the plug body and is engaged in the cam 3. The plug body is a cylinder provided at a side thereof with a groove.

In the case of locking, the physical part at the groove of the plug body of the rotary plug 1 rotates into a moving passage of the rotary tongue 12. In the case of unlocking, the physical part at the groove of the plug body of the rotary plug 1 rotates out of the moving passage of the rotary tongue 12.

The rotary shaft sequentially passes through the half gear 2, the cam 3, and the engaging groove gear 4. The cross-section of the rotary plug 1 is circular or rectangular; and the cross-section at the groove of the rotary plug 1 is semicircular or rectangular.

The electronic actuating part 8 includes a gear motor and a motor actuated gear, the motor actuated gear being meshed with the engaging groove gear 4, and the gear motor being used to drive the motor actuated gear.

The cam 3 includes a boss 5 and fasteners 6, the fasteners 6 being arranged on the bottom surface of the cam 3 fit with the engaging groove gear 4, and the boss 5 being arranged on a side edge of the cam 3.

Fasteners 6 are arranged on the bottom surface of the engaging groove gear 4 fit with the cam 3, and the engaging groove gear 4 is fit with the cam 3 through the fasteners 6.

The half gear 2 includes a shifting block 21. The shifting block 21 is arranged on a bottom surface of the half gear 2 opposite to the cam 3. The shifting block 21 is fit with the boss 5. When the half gear 2 is actuated by the mechanical actuating mechanism to rotate, after the shifting block 21 rotates to the position of the boss 5, with the continuous rotation of the half gear 2, the shifting block 21 carries the boss 5 to rotate together, that is, the half gear 2 carries the cam 3 to rotate together.

The electronic-mechanical dual control lock further includes a lock case. The electronic control mechanism, the mechanical control mechanism, the rotary plug 1, and the rotary tongue 12 are all mounted in the lock case. The rotary tongue 12 has a cross-section shape of a fan, and has a rotary shaft located at the circle center of the fan.

Figure 4:
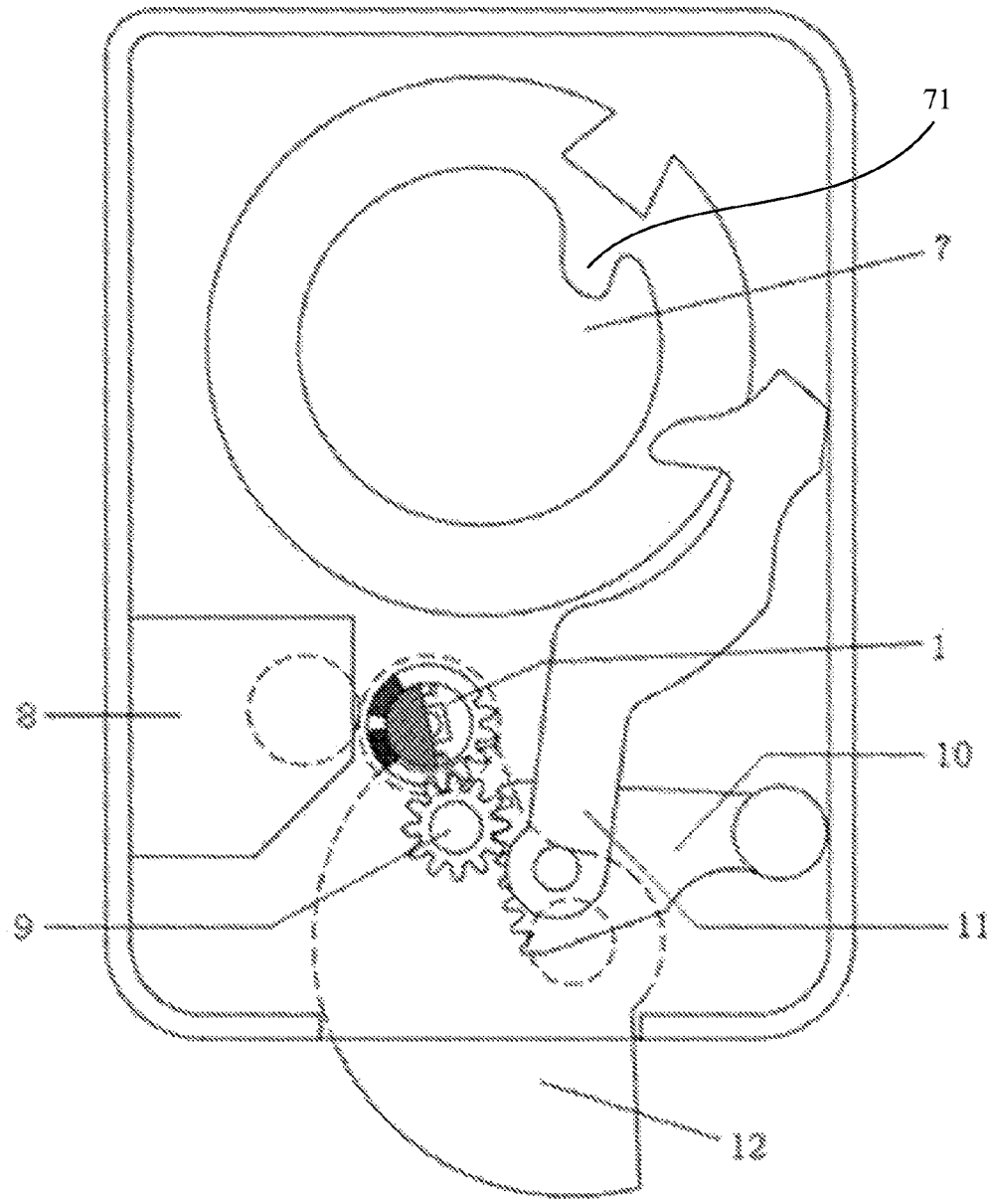
FIG. 4 is a schematic overall structural view of an electronic-mechanical dual control lock according to the present invention.

As shown in FIG. 4, an electronic-mechanical dual control lock of the present invention includes:

an electronic control mechanism, including an electronic actuating part 8, an engaging groove gear 4, and a cam 3, where the electronic actuating part 8 includes an electronic actuating gear, the electronic actuating gear is meshed with the engaging groove gear 4, a bottom surface of the engaging groove gear 4 is fit with a bottom surface of the cam 3, and the cam 3 is driven by the engaging groove gear 4;

a mechanical control mechanism, including mechanical code shifting pieces 7, a pulling claw 11, a fan-shaped gear 10, a transmission gear 9, and a half gear 2, where one end of the pulling claw 11 is arranged on the periphery of the mechanical code shifting pieces 7, a claw groove 71 is provided on the periphery of the mechanical code shifting pieces 7, and the other end of the pulling claw 11 is rotatably mounted on an end of the fan-shaped gear 10 near gear teeth, the transmission gear 9 is separately meshed with the fan-shaped gear 10 and the half gear 2, and a rotary shaft is arranged on an end of the fan-shaped gear 10 far away from the gear teeth; the transmission gear 9 is separately meshed with the fan-shaped gear 10 and the half gear 2, and the cam 3 is driven by the half gear 2; a rotary plug 1, including a rotary shaft and a plug body, where the rotary shaft is arranged at one end of the plug body and is engaged in the cam 3, and the plug body is a cylinder provided at a side thereof with a groove; a lock case, where the mechanical code shifting pieces 7 and the end of the fan-shaped gear 10 far away from the gear teeth are separately rotatably mounted on the lock case; a rotary tongue 12, rotatably mounted on the lock case, where the groove of the plug body of the rotary plug 1 is rotatable into or out of the moving trajectory of the rotary tongue 12.

Figure 5:
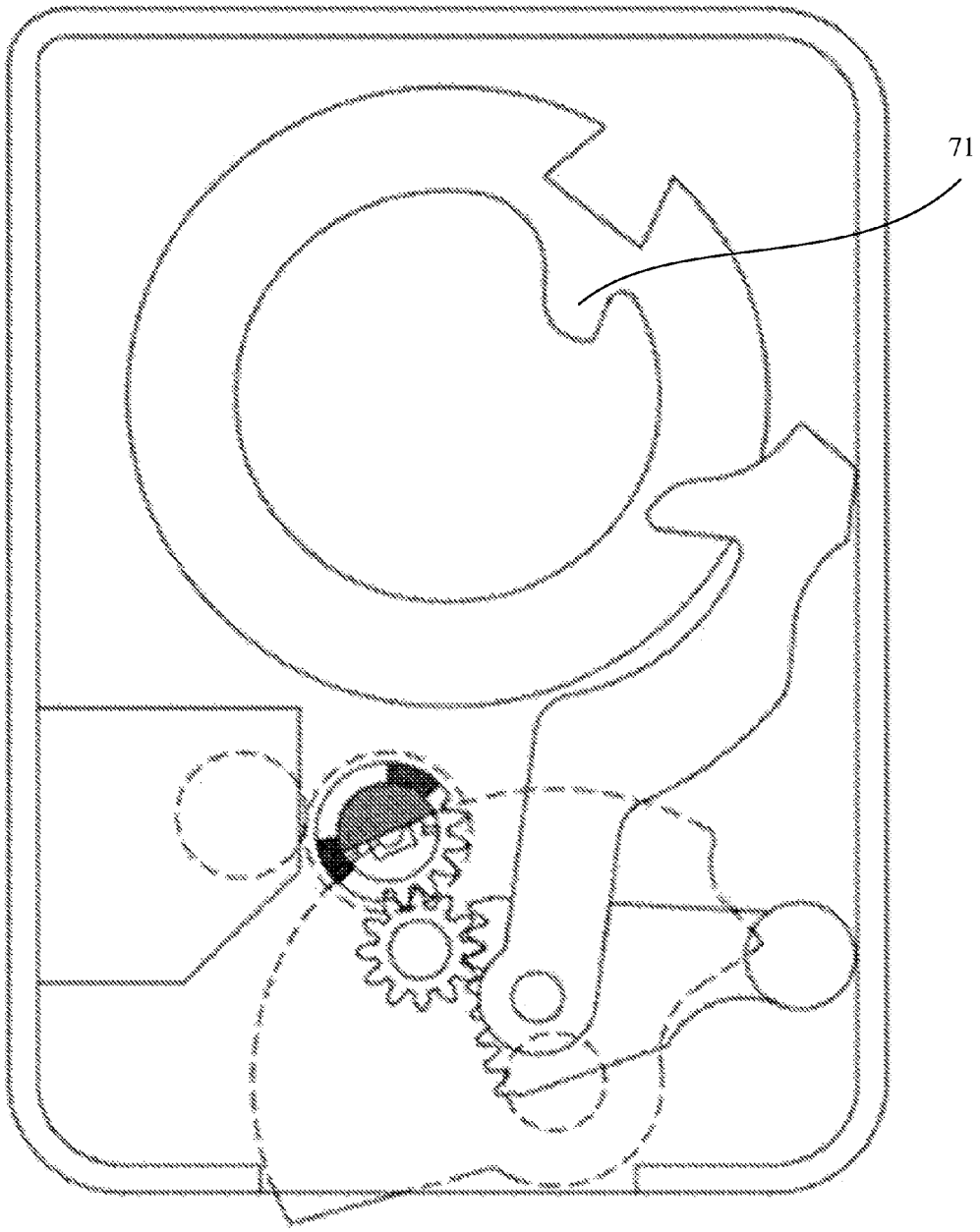
FIG. 5 is a schematic view illustrating electronic unlocking according to the present invention.

As shown in FIG. 5, when the electronic-mechanical dual control lock of the present invention/utility model is to be opened in an electronic mode, the electronic actuating part 8 drives the electronic actuating gear to rotate, to carry the engaging groove gear 4 to rotate. During the rotation of the engaging groove gear 4, the fasteners on the lower end surface of the engaging groove gear 4 press against the fasteners on the upper end surface of the cam, so the engaging groove gear 4 carries the cam 3 to rotate together, and meanwhile the cam 3 carries the rotary plug 1 to rotate together. When the physical part at the groove of the rotary plug 1 rotates out of the moving trajectory of the rotary tongue, the rotary tongue rotates toward the interior of the lock case, thereby achieving unlocking.

Figure 6:
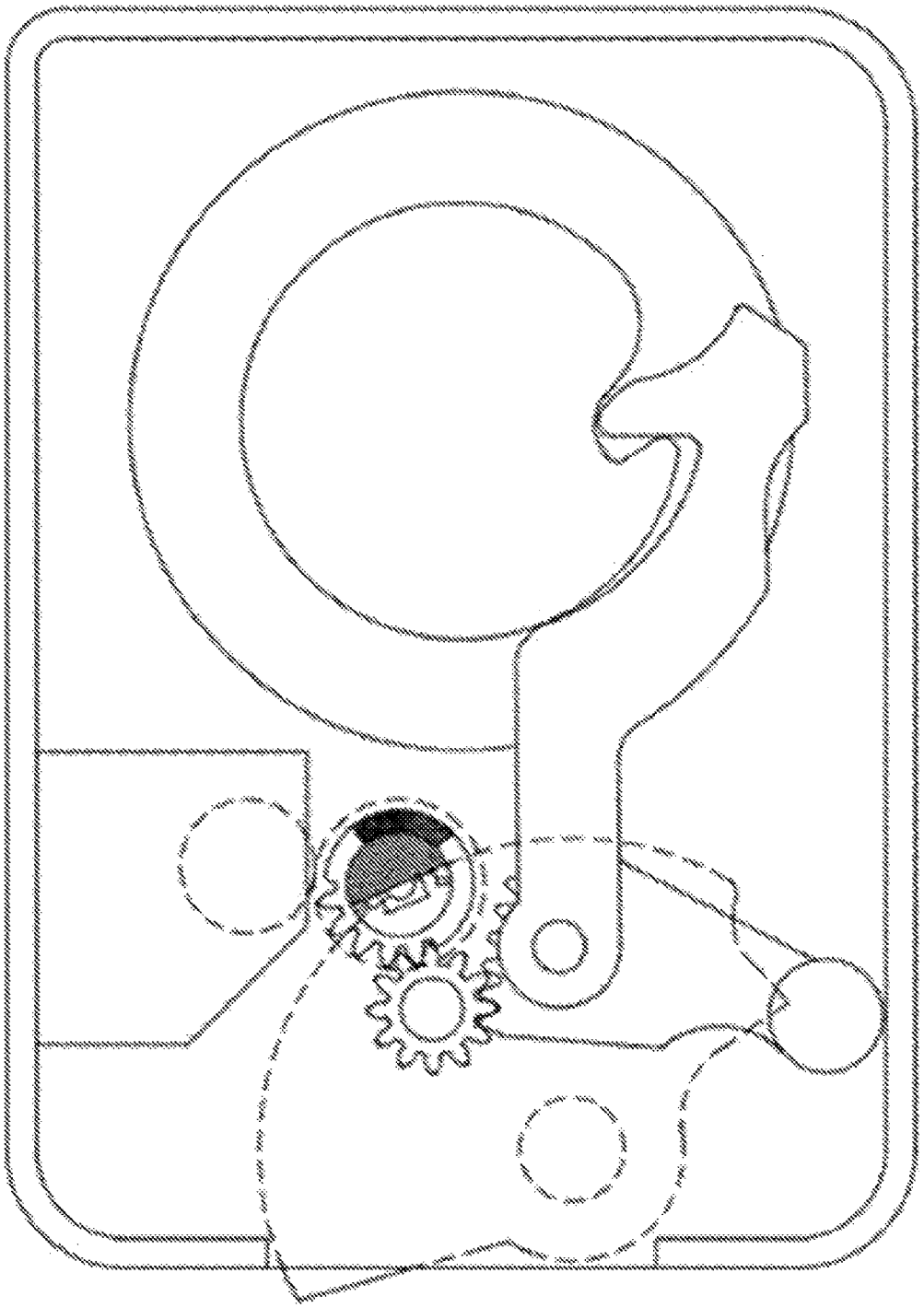
FIG. 6 is a schematic view illustrating mechanical unlocking according to the present invention.

As shown in FIG. 6, when the electronic-mechanical dual control lock of the present invention/utility model is to be opened in a mechanical mode, when grooves of the mechanical code shifting pieces 7 overlap through rotation of an external code disk on the lock case, the pulling claw 11 can move and is engaged in the grooves of the mechanical code shifting pieces 7, and the mechanical code shifting pieces 7 rotate to carry the pulling claw 11 to rotate, the lower end of the pulling claw 11 carries the fan-shaped gear 10 to rotate about the end thereof far away from the gear teeth, the fan-shaped gear 10 carries the transmission gear 9 to rotate, the rotate gear 9 carries the half gear 2 to rotate, and the shifting block on the side of the half gear 2 carries the boss 5 of the cam 3 to move together, thereby carrying the rotary plug engaged in the cam 3 to rotate together. When the physical part at the groove of the rotary plug 1 rotates out of the moving trajectory of the rotary tongue, the rotary tongue rotates towards the interior of the lock case, thereby achieving unlocking.

The implementations of the present invention are specifically described in detail above, but they are not to be construed as limiting the scope of the present invention. It should be noted that several modifications and improvements can be made by one of ordinary skill in the art without departing from the concept of the present invention. All these modifications and improvements are within the protection scope of the present invention.

What is claimed is:

1. An electronic-mechanical dual control lock, comprising an electronic control mechanism, a mechanical control mechanism, a half gear, a cam, a rotary plug, and a rotary tongue, wherein the electronic control mechanism comprises an electronic actuating part and an engaging groove gear, the electronic actuating part being meshed with the engaging groove gear, and a bottom surface of the engaging groove gear being fit with a bottom surface of the cam;

the mechanical control mechanism comprises a mechanical actuating part and the half gear, the mechanical actuating part being meshed with the half gear, and the cam is driven by the engaging groove gear and the half gear separately and independently;

the rotary plug comprises a rotary shaft and a plug body, the rotary shaft being arranged at one end of the plug body and being engaged in the cam, and the plug body being a cylinder provided at a side thereof with a groove; and in the case of locking, a physical part at the groove of the plug body of the rotary plug rotates into a moving passage of the rotary tongue; and in the case of unlocking, the physical part at the groove of the plug body of the rotary plug rotates out of the moving passage of the rotary tongue.

2. The electronic-mechanical dual control lock according to claim 1, wherein the rotary shaft sequentially passes through the half gear, the cam, and the engaging groove gear.

3. The electronic-mechanical dual control lock according to claim 2, wherein the electronic actuating part comprises a gear motor and a motor actuated gear, the motor actuated gear being meshed with the engaging groove gear, and the gear motor being used to drive the motor actuated gear.

4. The electronic-mechanical dual control lock according to claim 3, wherein a cross-section at a non-groove part of the rotary plug is circular or rectangular; and the cross-section at the groove of the rotary plug is semicircular or rectangular.

5. The automatic locking mechanism for a lockset according to claim 3, wherein the cam comprises a boss and fasteners, the fasteners being arranged on the bottom surface of the cam fit with the engaging groove gear, and the boss being arranged on a side edge of the cam.

6. The automatic locking mechanism for a lockset according to claim 5, wherein fasteners are arranged on the bottom surface of the engaging groove gear fit with the cam, and the engaging groove gear is fit with the cam through the fasteners.

7. The automatic locking mechanism for a lockset according to claim 5, wherein the half gear comprises a shifting block, the shifting block being arranged on a bottom surface of the half gear opposite to the cam, and the shifting block being fit with the boss.

8. The automatic locking mechanism for a lockset according to claim 1, further comprising a lock case, wherein the electronic control mechanism, the mechanical control mechanism, the rotary plug, and the rotary tongue are all mounted in the lock case.

9. The automatic locking mechanism for a lockset according to claim 7, wherein the rotary tongue has a cross-section shape of a fan and has a rotary shaft located at a circle center of the fan.

10. An electronic-mechanical dual control lock, comprising an electronic control mechanism, a mechanical control mechanism, a half gear, a cam, a rotary plug, and a rotary tongue, wherein the electronic control mechanism comprises an electronic actuating part and an engaging groove gear, the electronic actuating part being meshed with the engaging groove gear; the mechanical control mechanism comprises a mechanical actuating part and the half gear, the mechanical actuating part being meshed with the half gear; the cam is driven by the engaging groove gear and the half gear separately and independently;

the rotary plug comprises a rotary shaft and a plug body, the rotary shaft being arranged at one end of the plug body, sequentially passing through the half gear, the cam, and the engaging groove gear, and being engaged in the cam, and the plug body being a cylinder provided at a side thereof with a groove; the groove of the plug body of the rotary plug is rotatable into or out of a motion trajectory of the rotary tongue.

11. The automatic locking mechanism for a lockset according to claim 6, wherein the half gear comprises a shifting block, the shifting block being arranged on a bottom surface of the half gear opposite to the cam, and the shifting block being fit with the boss.

12. The automatic locking mechanism for a lockset according to claim 2, further comprising a lock case, wherein the electronic control mechanism, the mechanical control mechanism, the rotary plug, and the rotary tongue are all mounted in the lock case.

13. The automatic locking mechanism for a lockset according to claim 3, further comprising a lock case, wherein the electronic control mechanism, the mechanical control mechanism, the rotary plug, and the rotary tongue are all mounted in the lock case.

14. The automatic locking mechanism for a lockset according to claim 4, further comprising a lock case, wherein the electronic control mechanism, the mechanical control mechanism, the rotary plug, and the rotary tongue are all mounted in the lock case.

15. The automatic locking mechanism for a lockset according to claim 5, further comprising a lock case, wherein the electronic control mechanism, the mechanical control mechanism, the rotary plug, and the rotary tongue are all mounted in the lock case.

16. The automatic locking mechanism for a lockset according to claim 6, further comprising a lock case, wherein the electronic control mechanism, the mechanical control mechanism, the rotary plug, and the rotary tongue are all mounted in the lock case.

* * * * *